US005890607A

United States Patent [19]

Maglione

[11] Patent Number: 5,890,607

[45] Date of Patent: Apr. 6, 1999

[54] MODULAR DISPLAY

[76] Inventor: Stephen Thomas Maglione, 71 Baltusrol Way, Far Hills, N.J. 07931

[21] Appl. No.: 944,455

[22] Filed: Oct. 6, 1997

[51] Int. Cl.[6] ..... A47F 5/00

[52] U.S. Cl. ..... 211/189; 211/182; 211/193; 211/194; 108/108

[58] Field of Search ..... 211/189, 193, 211/194, 182, 190, 187; 108/108, 109

[56] References Cited

U.S. PATENT DOCUMENTS

| | | | |
|---|---|---|---|
| 2,991,889 | 7/1961 | Levy et al. . | |
| 4,045,104 | 8/1977 | Peterson | 211/182 |
| 4,508,231 | 4/1985 | Honickman | 211/189 X |
| 4,785,946 | 11/1988 | Sorensen | 211/189 X |
| 4,805,783 | 2/1989 | Mayer . | |
| 4,825,601 | 5/1989 | Halverson . | |
| 4,896,992 | 1/1990 | Muhlethaler | 211/182 X |
| 4,951,827 | 8/1990 | Moransais . | |
| 5,255,803 | 10/1993 | Pavone et al. . | |
| 5,566,844 | 10/1996 | Bernardin . | |
| 5,607,070 | 3/1997 | Hellyer . | |

*Primary Examiner*—Robert W. Gibson, Jr.

[57] ABSTRACT

A preferably particle board box forms a base with a rectangular recess therein. A panel of slats that is formed of molded thermoplastic material has opposite edges attached to mating posts. The posts are formed from a common extruded thermoplastic tube and each have a longitudinally extending channel for receiving a panel edge which may be bonded thereto. An uppermost section is formed of like panel and post material as all of the section modules and is secured to the next lower intermediate section by post connectors comprising molded plastic U-shaped members which are locked to and protruding depending from the core of the upper section posts. The connectors mate in closely received releasable engagement with the open cores of the posts of the next lower section. The intermediate section module has depending connectors protruding from its posts for mating in the cores of the upper ends of the bottommost section module which is closely received in the support box recess and optionally screwed thereto. A header formed of molded U-shaped thermoplastic sheet overlies the uppermost section module. Headers of different configurations may also be used. The assembly is assembled and knocked down quickly generally without tools or complex fastener elements.

20 Claims, 4 Drawing Sheets

FIG. 1
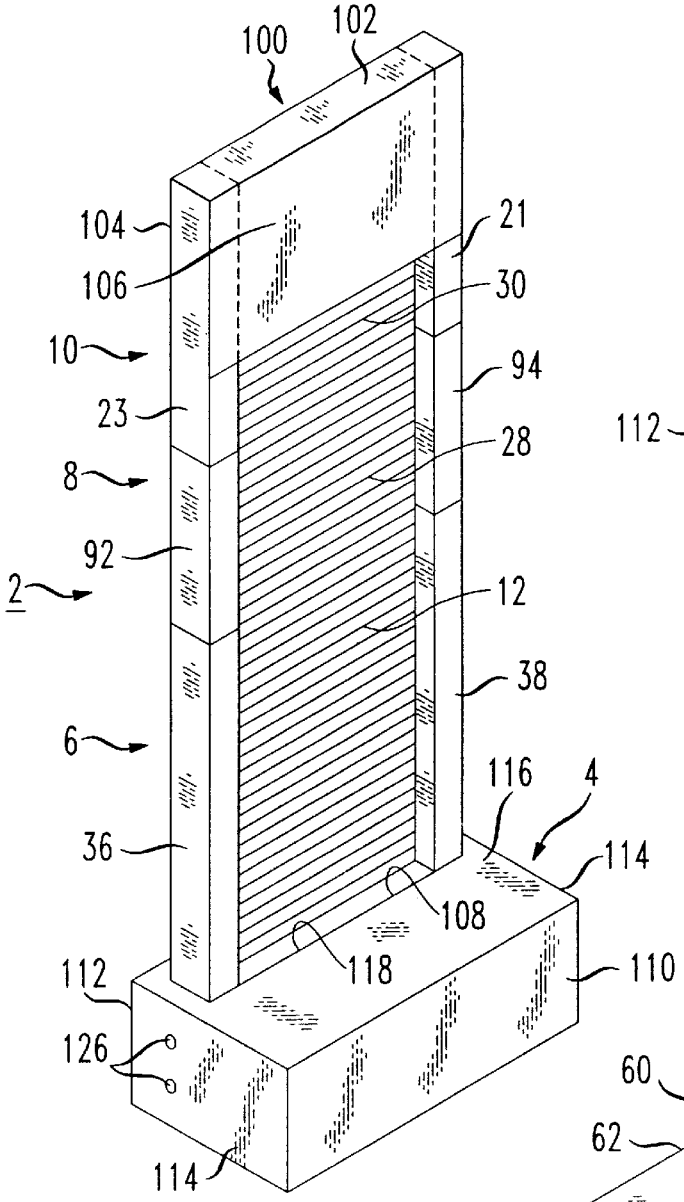
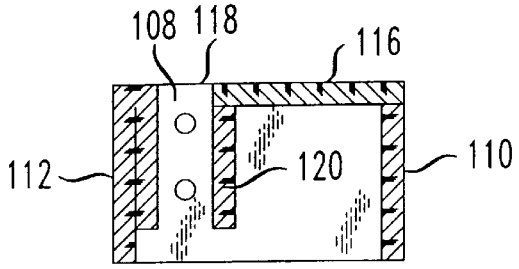
FIG. 8
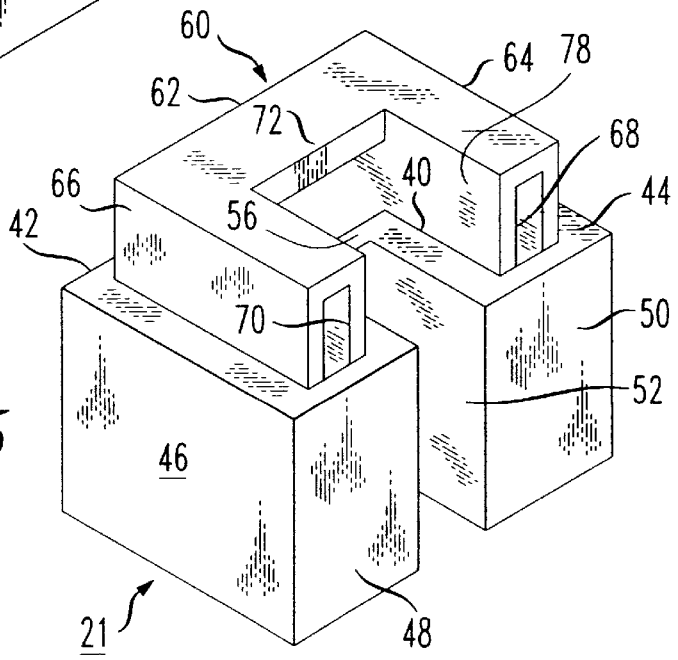
FIG. 15

FIG. 7
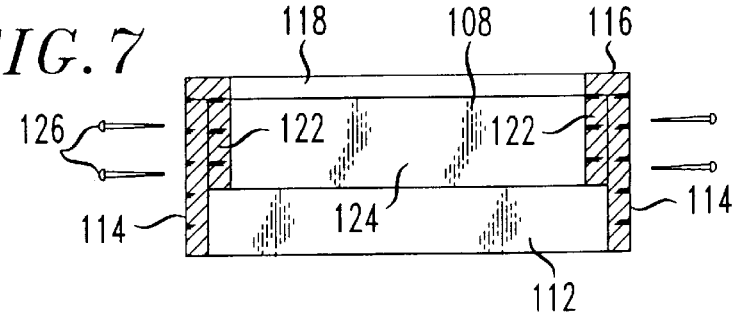
FIG. 6
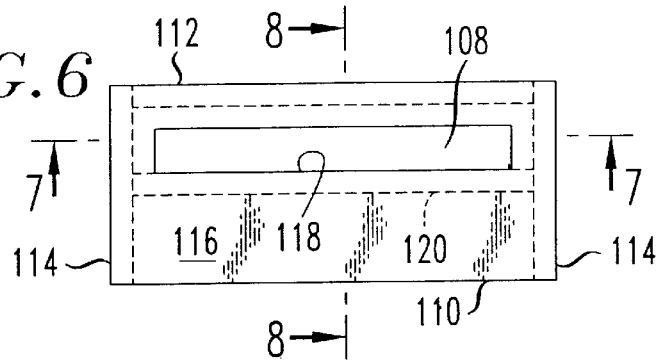
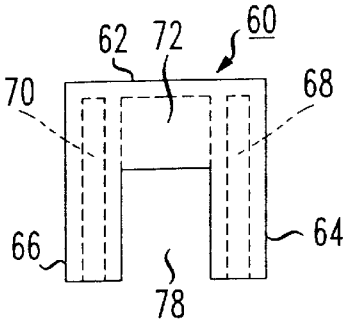
FIG. 9
FIG. 10
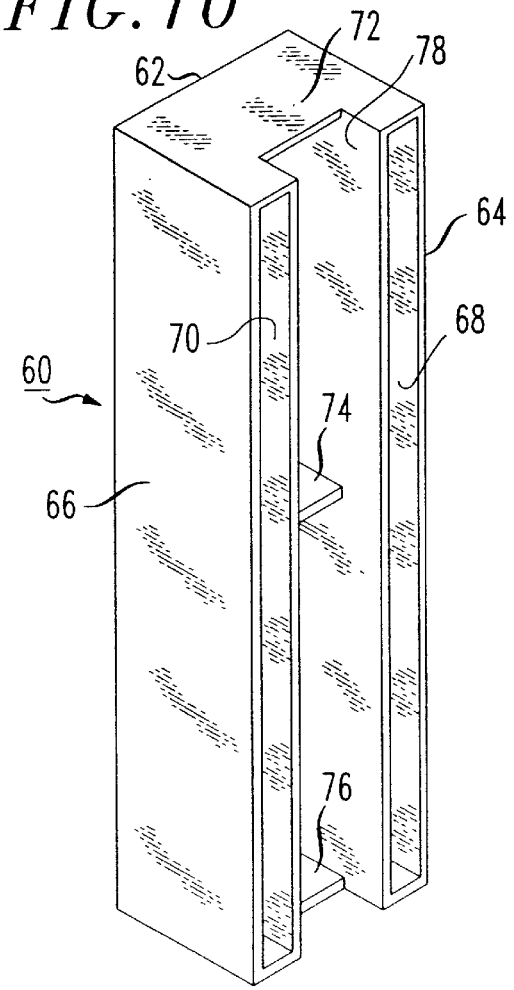
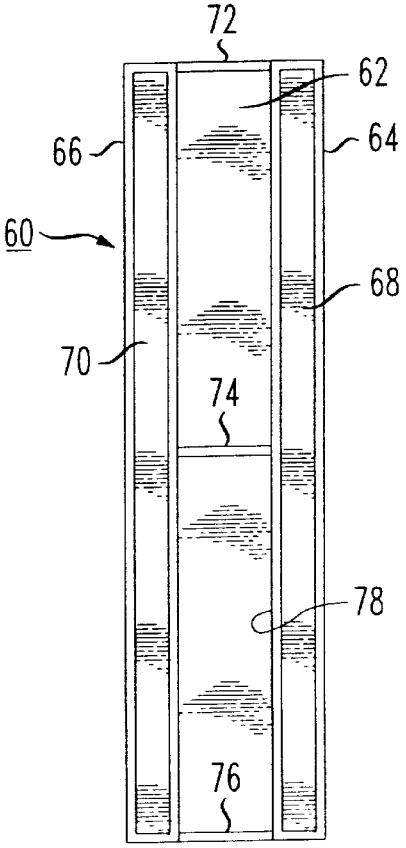
FIG. 11

FIG. 12
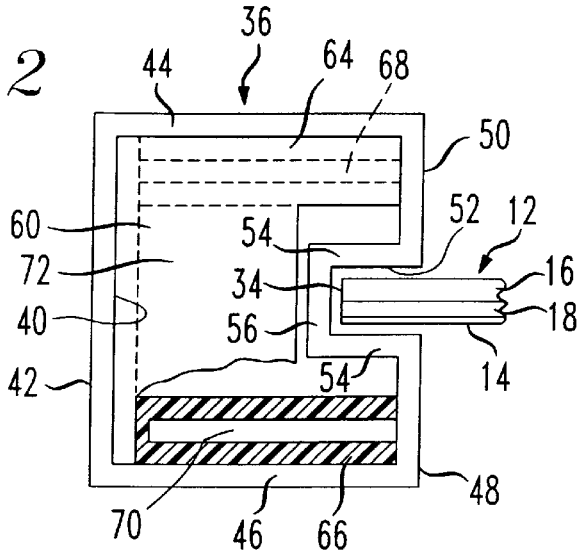
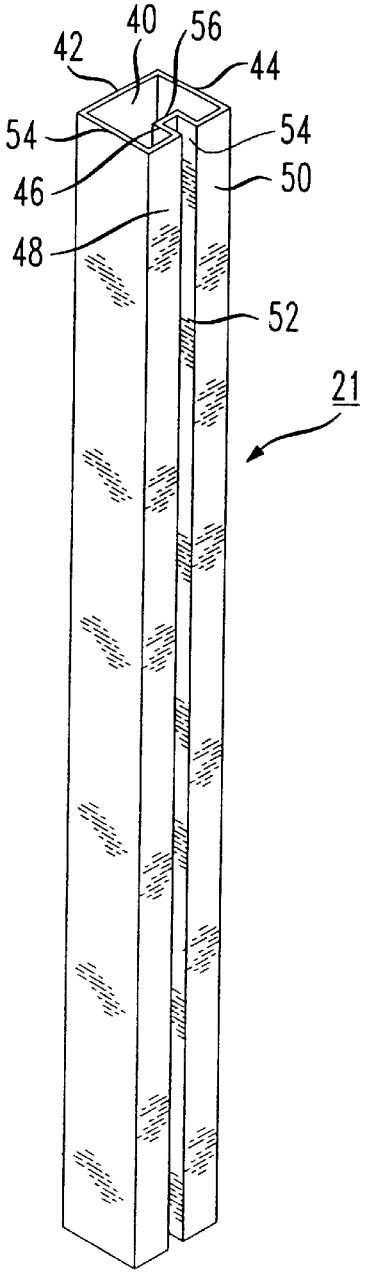
FIG. 14
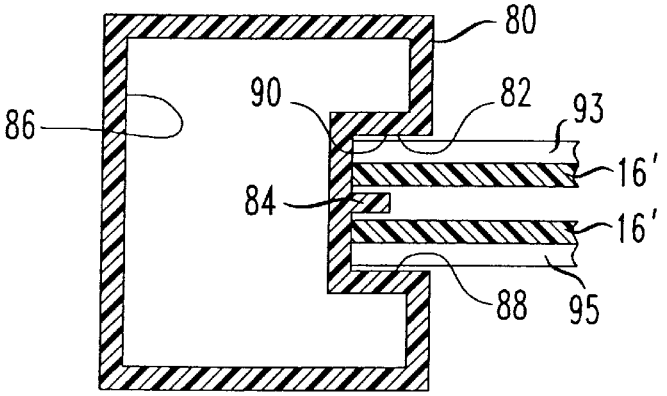
FIG. 13
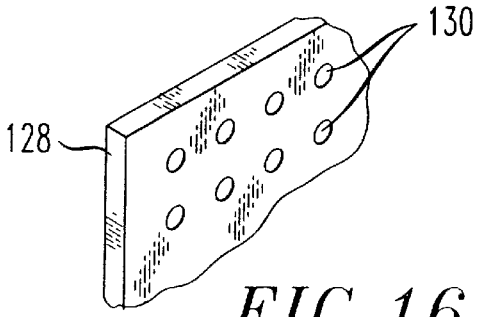
FIG. 16

MODULAR DISPLAY

The present invention relates to displays for displaying merchandise and the like, and more particularly, to modular displays.

Modular displays generally comprise stand alone planar panels and may include slats for hanging or otherwise securing articles thereto. U.S. Pat. No. 5,607,070 discloses a modular display which is assembled and disassembled without tools. The display includes a support frame comprising support posts connected by a cross member. A display panel is removably secured to the posts. The posts and panel are secured to a relatively complex base comprising horizontal posts and casters. Connecting screws and mating keyhole slots are used to attach the panel to the posts. Tabs are disclosed for connecting an extension assembly for increasing the height of the display. The use of screws, slots and cross members are relatively complex and costly to fabricate. The panels also include outer vertical margins for attachment to the posts, adding additional costly and assembly elements to the structure.

U.S. Pat. No. 4,805,783 discloses a slat advertising wall formed by a number of panels having connecting channels on the panels and mounted in a frame including lateral channel members for receiving the panels. Each of the panels comprises a number of elements and forms a separate assembly which needs to be assembled to form a composite display. The panels may be translucent and include interior lights. This is a relatively costly display system requiring T-shaped connectors to form the panels.

U.S. Pat. Nos. 5,255,803 and 5,566,844 disclose relatively complex and costly display systems. U.S. Pat. Nos. 2,991,889 and 4,951,827 illustrate still other displays. U.S. Pat. No. 4,825,601 discloses modular slot wall members comprising multiple components.

The present inventor recognizes a need for a simple low cost knock down modular display that can be assembled quickly and easily. Also, a neat clean looking display is desired that does not employ complex components, but rather uses relative few components to form the display.

A display according to an embodiment of the present invention comprises a base having an upper surface with a recess therein. A pair of first tubular hollow core posts each have a longitudinal channel extending along the length thereof inwardly into the core forming a U-shaped core with a U-shaped opening at each post end. A planar display panel has opposing longitudinal edges, each edge being secured in a channel of a different post with the panel between the posts. The recess is for receiving and securing the panel and posts extending from the base upper surface to form a first upright display module.

In accordance with an embodiment, an extension display module comprises a further pair of the posts and a further planar display panel secured to the channels of and between the further posts, further including a connector secured in each core and projecting from the opening of one of the pair of posts of the first and extension modules, each projecting connector for releasably engaging the opening and core of the posts of the other of the modules.

In a still further embodiment, the connectors are U-shaped and complementary to the post cores.

In a further embodiment, the connector comprises an elongated generally U-shaped in plan view channel shaped member with a base wall and two spaced leg walls, each the leg walls having a hollow core extending along the length of that leg.

In a further embodiment, a plurality of ribs are in the connector channel secured to the connector base and leg walls.

IN THE DRAWING

FIG. 1 is an isometric view of an assembled modular knock down display according to one embodiment of the present invention;

FIG. 6 is a plan view of the base of the display of FIG. 1;

FIG. 7 is an elevation sectional front view of the base of FIG. 6 taken along lines 7—7;

FIG. 8 is an elevation sectional side view of the base of FIG. 6 taken along lines 8—8;

FIGS. 9, 10 and 11 are respective end plan, isometric and front elevation views of a connector used in the embodiment of FIGS. 1 and 2;

FIG. 12 is a plan end view of the connector of FIGS. 9–11 and post of FIGS. 1 and 2 assembled with a single display panel;

FIG. 13 is a plan sectional view of a post according to a second embodiment employing back-to-back display panels;

FIG. 14 is an isometric view of a representative post for use in the embodiment of FIG. 1;

FIG. 15 is an isometric end view of a connector and post assembly; and

FIG. 16 is a fragmented isometric view of a second display panel embodiment.

Figure 4:
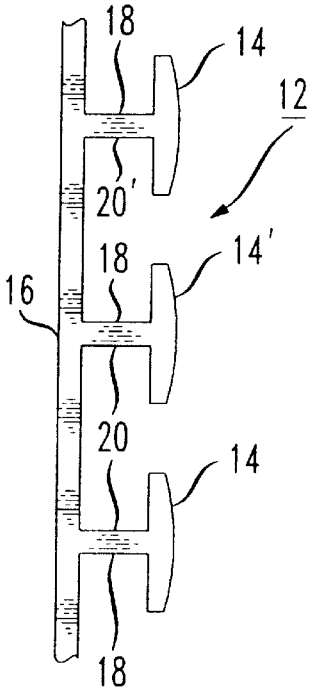
FIG. 4 is a fragmented end view of a portion of the display panel of FIG. 1.

In FIG. 1, modular knock down display 2 comprises a base 4, a lower modular section 6, an intermediate modular section 8 and an upper modular section 10. The sections together may be about 48 inches in height excluding the base 4 and about 20.5 inches wide. Section 6, FIG. 2, comprises a representative planar panel 12 employed in the different sections and comprises a plurality of slats 14 secured to a back planar sheet panel 16, FIG. 4. In FIG. 4, the slats 14 are secured to panel 16 by a corresponding web 18. The slats 14, webs 18 and panel 16 form channels 20. The channels 20 are mirror images so that the orientation of the channels 20 does not matter, the slats 14 and channels 20 extending horizontally in FIGS. 1 and 2.

Figure 5:
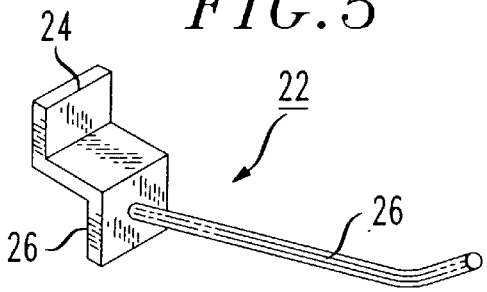
FIG. 5 is an isometric view of an article hanging peg for use with the display panel of FIG. 1.

The channels 20 and slats 14 receive pegs 22, FIG. 5. The panel 12 is rectangular and is preferably formed of molded thermoplastic material. The panels 14, 28 and 30 of the respective sections 6, 8 and 18 are preferably formed from identical panel sheet material.

The peg 22, FIG. 5, has a rear upper flange 24 which engages an upper channel 20' and a forward lower flange 26 parallel to and spaced from the rear flange. The lower flange 26 abuts the outer surface of a slat 14'. The peg 22 includes an article receiving rod 26 extending from the lower flange 26. The peg 22 and panels such as panel 12 are commercially available.

Figure 2:
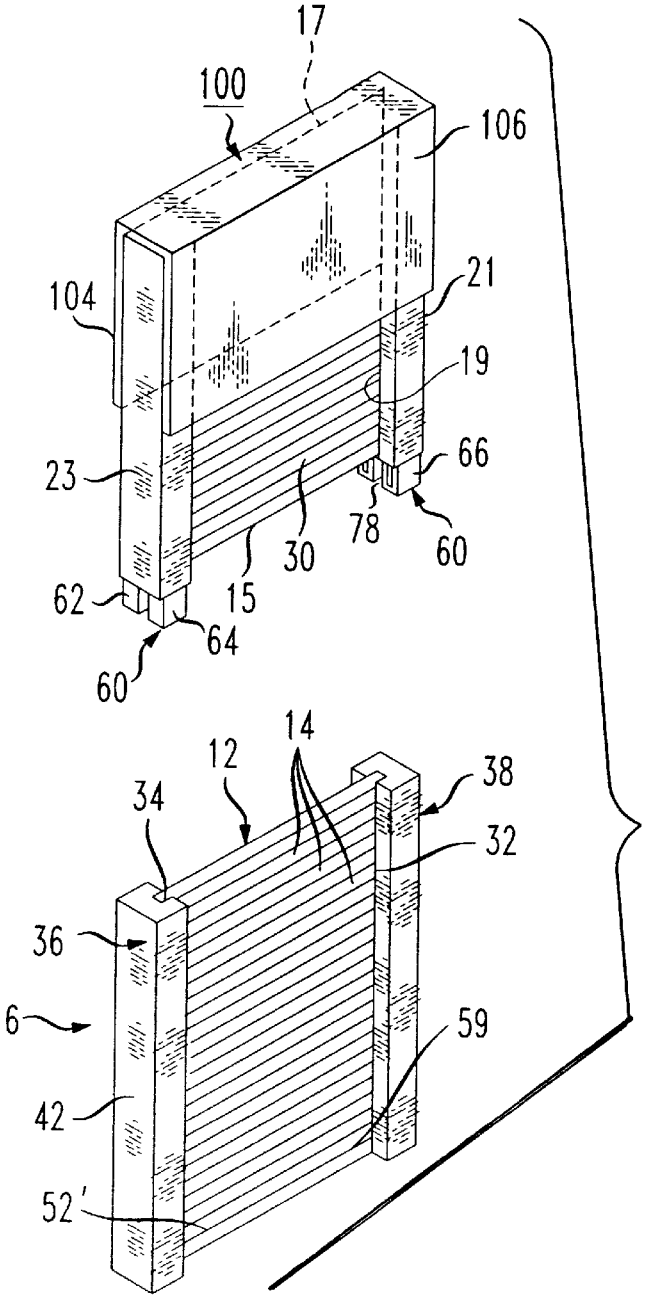
FIG. 2 is an exploded partially fragmented partially in section view of the lower portion of the display of FIG. 1.

In FIG. 2, the panel 12 has opposing longitudinal edges 32 and 34 extending for the length of the panel. The edge 34 is secured to tubular post 36 and the edge 32 is secured to preferably identical tubular post 38.

In FIG. 14, representative post 36 comprises preferably a tubular thermoplastic extrusion, generally rectangular in end plan view, FIG. 12. The post 36 has a hollow generally U-shaped core 40 formed by planar base wall 42, two planar lateral side walls 44 and 46, two spaced apart coplanar front walls 48 and 50 and an inwardly depending rectangular in section channel 52. The channel 52 is formed by two side walls 54 and a base wall 56. The channel 52 extends for the length of the post 36.

The post 38 on the opposite side of the panel 12 is formed from an identical extrusion as post 36. The posts by way of example may be about 2 inches width across the front and back, and about 1.5 inches deep along the lateral sides. The posts may comprise 0.10 inch thick extruded thermoplastic material. The channel 52 may be about 0.375 inches wide, with a panel 12 of about 0.25 inches thick at its thickest point, left to right, FIG. 4. The panel 12 is preferably bonded to the posts 36 and 38 in the channels thereof with a suitable adhesive.

Cross members, not shown, are optional due to their added cost, and would be formed from the same extrusion as posts 36 and 38. The bottom and/or top edge of a panel, e.g., panel 12, would be inserted into and bonded to the channel in the cross member post. Such cross members would terminate at the side posts and are generally not necessary for the strength of the display and add unnecessary cost.

Figure 3:
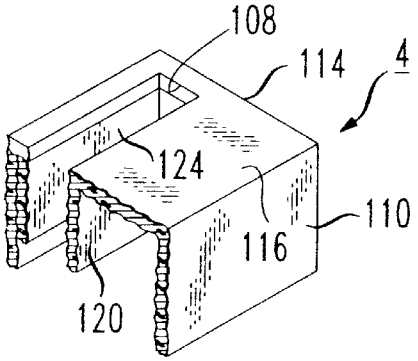
FIG. 3 is an isometric view of a header overlay unit overlying a modular upper display section of the embodiment of FIG. 1.

Upper section 10, FIG. 3, comprises a rectangular panel 30 having a lower edge 15 and an upper edge 17. Panel 30 fits into channels 19 (one being shown) in the respective identical side posts 21 and 23 which are formed from identical extrusions as side posts 36 and 38, of section 6, FIG. 2.

Inserted in the hollow post cores 40 of posts 21 and 23 and protruding depending through the openings at the lower ends of posts 21 and 23 are two respective identical connectors 60. In FIGS. 9–11, representative connector 60 is generally U-shaped in end plan view (FIG. 9). The connector 60 has a base wall 62 and two legs 64, 66. The connector 60 U-shaped exterior is complementary to the post 21 U-shaped core 40 (and post 23 core) and is closely received therein in relatively moderately releasable tight friction fit. Preferably, the connector 60 is bonded to the mating post 21 and 23 core to which it is attached and from which it depends. Any suitable adhesive may be used for the various bonding operations. Connectors (not shown) depend from and are bonded to the posts of the intermediate section 8 for engaging the upper open ends and cores of the lower section 6 posts 36 and 38.

The connector legs 64 and 66, FIGS. 9–11, are mirror images. The connector legs 64, 66 are hollow with a rectangular vertical recess 68, 70 respectively. The recesses 68 and 70 are in communication with the legs exterior opposite the base wall 62. These recesses serve to save material, the connectors being molded thermoplastic. Reinforcing transverse spaced ribs 72, 74 and 76 are located in the channel 78 formed by legs 64 and 66 and base wall 62. The ribs 72, 74 and 76 extend partially the depth of the legs as shown and are molded one piece integral with the connector 60. The ribs accommodate the channel 52 in the post 21 (and in post 23), FIG. 12.

The connector 60 is preferably tightly received in the core 40 of the upper post 21 or 23 to lock it to the post. Adhesive may be use if necessary to achieve a locked arrangement therebetween. The connector 60 is preferably about 5 inches long. Primed numbers in the drawing represent the same parts as the unprimed reference numerals. In the various figures, identical reference numerals identify identical parts.

In the alternative, the connectors 60 may be attached to the upper ends of a lower section posts, such as posts 36 and 38, FIG. 2, and the corresponding upper ends of the posts of section 8, FIG. 1, with no connectors depending from any of the sections. Connectors (not shown) in the embodiment of FIG. 1, depend from the posts 92 and 94 of intermediate section 8 for releasable mating in the upper ends of the hollow cores of the lower section 6 posts 36 and 38. All of the depending connectors mating in the lower posts are releasably secured to such lower posts via the post cores.

In FIG. 12, the panel 12 is received in post 21 channel 52. The spacing between the panel 12 and the post is exaggerated. The panel edges are preferably bonded to the channel 52 so that the fit thereto of the panel 12 is not important. The connector 60 ribs 72, 74 and 76 are optional. The connector legs 64 and 66 provide rigidity between the post and the connector in cooperation with the walls 62, 42 of the connector 60 and post 36, respectively. The connectors, panel and posts of the different sections 6, 8 and 10 each form a display module.

In the alternative to posts 36 and 38 and the corresponding posts of the different sections, a post 80 of a second embodiment, FIG. 13, may be provided. A channel 82 depends inwardly into the post 80 core 86. A central medial wall 84 divides the channel 82 into two subchannels 88, 90. Two like panels 93 and 95 are in respective subchannels 88, 90. The panels 92 and 94 are fabricated of the same material as panel 12. The post 80 exterior dimensions are otherwise the same as posts 21, 23, 36, 38, 92 and 94 of the respective sections 10, 6 and 8, the channel 90 being wider than the channel 52 in the posts 21, 23 and so on. The panels 93 and 95 are in back-to-back relation with the back panels 16' in facing spaced relation.

In FIG. 1, the section 8 forms an extension module comprising panel 28 and posts 92 and 94 and are constructed similarly as panel 12 and posts 21, 23, 36 and 38. Section 8 preferably may be shorter in length (height). No cross members are used at the upper and lower panel edges of any of the sections. Section 8 has two connectors (not shown) depending downwardly from the posts toward the top of the lower section posts 36 and 38 for releasable engagement with the upper facing openings of posts 36 and 38 of lowermost section 6. These connectors are identical to connector 60 and fit in these posts in the same manner as described in connection with posts 21 and 23 and mating posts 94 and 92. The panel 28 and posts 92 and 94 thus form a continuous display section with section 6. Section 6 preferably has a height of about 29.5 inches above the base 4, FIG. 1 and section 8 has a height preferably of about 17.5 inches above section 6. The uppermost section 10 is optional.

While three modular sections are shown, more or fewer such sections and extensions may be employed according to a given implementation. No cross member is used in any of the sections. In the alternative, a top cross member (not shown) may be used on the upper edge of the section 10.

In FIGS. 1 and 3, a U-shaped header 100 is formed of molded thermoplastic sheet material. The header 100 comprises a base wall 102 and two depending legs 104 and 106 depending at right angles to wall 102. Legs 104 and 106 may cover all or partially the section 10. In FIG. 1, the header 100 covers about ⅔rds of the section 10. The outer surface of the header 100 legs 104 and 106 may be used to receive indicia advertising and the like for the products (not shown) being displayed.

In the alternative to header 100, a further header (not shown) may replace section 10 panel 30 and comprise flat sheet material, molded sheet material displaying a product replica and other decorative or advertising sheet panel material in place of slats forming the panel 30. This further header fits into the channels of the lateral side posts 21 and 23. This or any header is optional. The section 10 preferably has an extension height of about 14 inches. Should the U-shaped header 100 not be used, then a cross member (not shown) comprising a post may be used across the top of the section corresponding to section 10. Caps (not shown) may cover the exposed openings of the cores of the uppermost section posts. Such caps may comprise flat covers with depending legs that mate in the post cores and may snap fit or be glued in place.

The base 4, FIGS. 1, 2, 6–8, is generally a rectangular wooden box with a rectangular recess 108. The base 4 rectangular front wall 110 is preferably formed of wood particle board with a veneer finish such as formica and the like or other finished surface as are all of the other outer walls of the base 4. The base has a rear wall 112 and two lateral side walls 114. A rectangular top wall 116 is fastened, e.g., screwed, to the front, rear and side walls which also may be screwed or bonded to each other. Top wall 116 has a rectangular opening 118. Recess 108 is enclosed by a front wall 120 depending from the top wall 116, side panel walls 122 and rear panel wall 124, the latter panel walls being interior of the outer walls 114 and 112. A bottom wall (not shown) may optionally enclose the bottom of the recess 108. Such a bottom wall would be attached to the side and rear panel walls and the recess front wall. The recess 108 is dimensioned to closely receive the section 6 (FIG. 2) side posts 36 and 38 with the slats of the panel 12 and the protruding side posts being visible externally. This provides a clean, neat appearance to the display. The recess 108 holds the display sections vertically during use.

Fasteners such as screws 126 may be used to secure the posts 36 and 38 to the base 4 via holes through the base 4 side walls 114, 122. The section 6 otherwise fits in the recess 108 and may rest on the floor or display support supporting the base. Preferably the screws 126 are employed to releasably secure the display section 6 to the base 4.

The display 2 base 4, sections 6, 8 and 10 are readily assembled and disassembled for use and shipping as needed. Any of sections 6, 8 or 10 may be used alone or in any combination with the other sections. Because certain shippers charge less for smaller packages, the display 2 when knocked down is packaged in such a small package. In addition, further room is provided in a conventional shipping box for articles to be displayed, permitting the display 2 and the merchandise to be displayed to be shipped in a low cost container to the final user destination.

It will occur to one of ordinary skill that various modifications may be made to the disclosed embodiments without departing from the spirit of the invention as defined in the appended claims. The disclosure is intended to be illustrative and not limiting. For example, while slats are preferred, an apertured display panel may be used in the alternative as shown in FIG. 16. In FIG. 16, panel 128 comprises sheet material formed with a plurality of arrays of peg receiving apertures 130. Such apertures and pegs for use therewith are well known. Ribs (not shown) may be used with the display panel 128 to stiffen it if necessary. The posts are formed with channels to accommodate such display panels, and the connectors for use therewith modified accordingly.

While thermoplastic posts, panels and connectors are preferred, other materials may be used in the alternative, as desired. The channel formed in and connector attached to each post simplifies the assembly of the panels thereto forming each modular section. The display may comprise any number of sections as desired. Each top section is finished by the overlying header regardless the finished appearance of that section otherwise. That is, the edge of the top section panel is covered by the header and does not detract from the appearance. In the place of a header, a cross member may be used to finish the top section panel edge.

What is claimed is:

1. A display comprising:

a base having an upper surface with a recess therein;

a pair of first tubular hollow core posts each having a longitudinal channel extending along the length thereof and depending inwardly into the core forming a U-shaped core with a U-shaped opening at each post end; and a planar display panel having opposing longitudinal edges, each edge being secured in a channel of a different post with the panel between the posts;

the recess for receiving and securing the panel and posts extending from the base upper surface to form a first upright display module.

2. The display of claim 1 including an extension display module comprising a further pair of the posts and a further planar display panel secured to the channels of and between the further posts, further including a connector secured in each core and projecting from the opening of one of the pair of posts of the first and extension modules, each said projecting connector for releasably engaging the opening and core of the posts of the other of the modules.

3. The display of claim 2 wherein the connectors are U-shaped and complementary to the post cores.

4. The display of claim 3 wherein the connector comprises an elongated generally U-shaped in plan view channel shaped member with a base wall and two spaced leg walls, each of said leg walls having a hollow core extending along the length of that leg.

5. The display of claim 3 wherein the connectors each have a channel formed by a base wall and two spaced leg walls and including a plurality of transverse ribs in the channel secured to the base and leg walls.

6. The display of claim 1 further including a U-shaped sheet material header for overlying an upper portion of the display module.

7. The display of claim 2 including a plurality of said extension display modules, the extension display module distal the base forming a display header for the display.

8. The display of claim 7 wherein the header includes a U-shaped sheet material member for overlying the distal display module at an edge thereof distal the base.

9. The display of claim 1 wherein the base comprises a rectangular structure in plan, side and front elevation views, the recess being rectangular in plan view, the base comprising a plurality of planar walls.

10. The display of claim 1 wherein the display panel is bonded to the posts.

11. The display of claim 1 wherein the channel of the posts each have a medial wall forming a pair of adjacent channels, the display further including a further panel in back-to-back relation with the planar display panel, the planar panel and further panel being received in a different one of the adjacent channels.

12. The display of claim 11 wherein the adjacent channels have a side wall distal the medial wall forming a primary channel, the medial wall having a depth in the primary channel smaller than the side walls.

13. In a display comprising a plurality of display modules each module comprising a first planar display panel connected to and between two longitudinally extending U-shaped hollow core tubular posts each having a channel receiving the first planar display panel and a support base having a recess for receiving an edge of one of the modules and an end of each of the posts, a connector for releasably interconnecting the modules comprising:

a U-shaped member complementary to the hollow core secured to and extending from at least one post of each the modules.

14. The display of claim 13 wherein the connector has a pair of spaced apart legs extending from a base wall and a plurality of cross ribs interconnecting the base wall and legs.

15. The display of claim 14 wherein the legs are hollow.

16. The display of claim 13 wherein the display panel, posts and connectors are each one piece integral thermoplastic material.

17. The display of claim 13 wherein the panel comprises an array of slats.

18. The display of claim 13 wherein the display panel is an apertured sheet.

19. The display of claim 13 wherein the posts each have a pair of adjacent channels, the display further including a further panel in back-to-back relation with the first display panel to form a plurality of modules with panels in the back-to-back relation, the panels of each module being secured in a different one of the adjacent channels.

20. The display of claim 19 wherein the adjacent channels each comprise a U-shaped channel having a medial wall extending therein for dividing the U-shaped channel into two adjacent channels contiguous with the medial wall.

* * * * *